United States Patent [19]

Capek et al.

[11] Patent Number: 4,891,545

[45] Date of Patent: Jan. 2, 1990

[54] FACEPLATE FRONT ASSEMBLY WITH IMPROVED TENSION MASK SUPPORT STRUCTURE

[75] Inventors: Raymond G. Capek, Elmhurst; David B. Danielson, Elk Grove, both of Ill.

[73] Assignee: Zenith Electronics Corporation, Glenview, Ill.

[21] Appl. No.: 178,175

[22] Filed: Apr. 6, 1988

[51] Int. Cl.[4] ..... H01J 29/81

[52] U.S. Cl. ..... 313/407; 313/408

[58] Field of Search ..... 313/402, 407, 408

[56] References Cited

U.S. PATENT DOCUMENTS 3,894,321 7/1975 Moore ..... 313/402

4,695,761 9/1987 Fendley ..... 313/407

*Primary Examiner*—Donald J. Yusko

*Assistant Examiner*—Michael Horabik

[57] ABSTRACT

A faceplate assembly for a color cathode ray tube includes a glass faceplate having on its inner surface a centrally disposed phosphor screen. A metal foil shadow mask is mounted in tension on a mask support structure located on opposed sides of the screen and secured to the inner surface of the faceplate. The support structure according to the invention comprises a hollow shell filled with at least two devitrified solder glass compositions each having a different viscosity when in the form of an undevitrified solder glass paste. A process for manufacturing the inventive mask support structure is also provided.

6 Claims, 3 Drawing Sheets

FACEPLATE FRONT ASSEMBLY WITH IMPROVED TENSION MASK SUPPORT STRUCTURE

CROSS-REFERENCE TO RELATED APPLICATIONS AND PATENTS

This application is related to but in no way dependent upon copending applications Ser. No. 832,493 filed Feb. 21, 1986, now U.S. Pat. No. 4,701,678; Ser. No. 832,556 filed Feb. 21, 1986, now U.S. Pat. No. 4,695,761; Ser. No. 925,424 filed Oct. 31, 1986, now U.S. Pat. No. 4,719,334; and Ser. No. 942,336 now U.S. Pat. No. 4,745,328 filed Dec. 16, 1986, all of common ownership herewith.

This specification includes an account of the background of the invention, a description of the best mode presently contemplated for carrying out the invention, and appended claims.

BACKGROUND OF THE INVENTION

1. Field of the Invention

This invention relates to color cathode ray picture tubes, and is addressed specifically to an improved front assembly for color tubes having shadow masks of the tension foil type in association with a substantially flat faceplate. The invention is useful in color tubes of various types, including those used in home entertainment television receivers, and in medium-resolution and high-resolution tubes intended for color monitors.

The use of the foil-type flat tension mask and flat faceplate provides many benefits in comparison to the conventional domed shadow mask and correlatively curved faceplate. Chief among these is a greater power-handling capability which makes possible as much as a three-fold increase in brightness. The conventional curved shadow mask, which is not under tension, tends to "dome" in picture areas of high brightness where the intensity of the electron beam bombardment is greatest. Color impurities result as the mask moves closer to the faceplate and as the beam-passing apertures move out of registration with their associated phosphor elements of the faceplate. The tension mask when heated distorts in a manner quite different from the conventional mask. If the entire mask is heated uniformly, there is no doming and no distortion until tension is completely lost; just before that point, wrinkling may occur in the corners. If only portions of the mask are heated, those portions expand, and the unheated portions contract, resulting in displacements within the plane of the mask; i.e., the mask remains flat.

The tension foil shadow mask is a part of the cathode ray tube front assembly, and is located in close adjacency to the faceplate. The front assembly comprises the faceplate with its screen consisting of deposits of light-emitting phosphors, a shadow mask, and support means for the mask. As used herein, the term "shadow mask" means an apertured metallic foil which may, by way of example, be about 0.001 inch thick, or less. The mask must be supported in high tension a predetermined distance from the inner surface of the cathode ray tube faceplate; this distance is known as the "Q-distance." As is well known in the art, the shadow mask acts as a color-selection electrode, or parallax barrier, which ensures that each of the three beams lands only on its assigned phosphor deposits.

The requirements for a support means for a foil shadow mask are stringent. As has been noted, the foil shadow mask is normally mounted under high tension, typically 30 lb/inch. The support means must be of high strength so the mask is held immovable; an inward movement of the mask of as little as 0.0002 inch can cause the loss of guard band. Also, it is desirable that the shadow mask support means be of such configuration and material composition as to be compatible with the means to which it is attached. As an example, if the support means is attached to glass, such as the glass of the inner surface of the faceplate, the support means must have a coefficient of thermal expansion compatible with the glass, and by its composition, be bondable to glass. Also, the support means should be of such composition and structure that the mask can be secured to it by production-worthy techniques such as electrical resistance welding or laser welding. Further, it is essential that the support means provide a suitable surface for mounting and securing the mask. The material of which the surface is composed should be adaptable to machining or other forms of shaping so that it can be contoured into near-perfect flatness so that no voids between the metal of the mask and the support structure can exist to prevent the positive, all-over contact required for proper mask securement.

Means for securing the shadow mask support to the inner surface of the faceplate may comprise a cement in the form of a devitrifying glass solder. (Solder glasses are also commonly known as "frits.") While satisfactory in the main, a cement of this type has significant disadvantages in that it is difficult to handle and apply in production, and it tends to create "pockets" in which screening fluids may lodge and be released later as contaminants. The cathodes of the electron gun are particularly susceptible to poisoning from contaminants. Also, deep-lying ones of such pockets may be connected to the surface of the solder glass by a tiny conduit. The air retained in the pocket may not be depleted during the exhaust cycle, but slowly leak out through the conduit after the tube is sealed, resulting in a reject as a "gassy" tube.

2. Prior Art

In referent U.S. Pat. No. 3,894,321 to Moore, of common ownership herewith, there is disclosed means for mounting a foil shadow mask on "rails" which extend from the faceplate. In another embodiment, the faceplate is shown as having an inner ledge that forms a continuous path around the tube, the top surface of which is a Q-distance away from the faceplate for receiving the foil mask.

In referent U.S. Pat. No. 4,695,761 to Fendley, of common ownership herewith, a foil shadow mask support structure is disclosed in which the structure has a cross-section in the form of an inverted "V", the narrow end of which provides for receiving the mask, and wherein the wide, open end is secured to the faceplate. The means of securement is by fillets of solder glass. Other foil mask support structure embodiments are also disclosed, such as a hollow tube and a rectangle.

In referent application Ser. No. 942,336 now U.S. Pat. No. 4,745,328 of common ownership herewith, there is disclosed a support structure for a tensed foil shadow mask comprising an inverted channel member of metal with a stiffening core of a material such as ceramic secured within, and lateral to, the channel member. In one embodiment of the invention, the space between the stiffening core and the inner walls of the channel is filled with a devitrified glass frit. In another embodiment, a ceramic slurry is poured into a V-shaped support member and is allowed to set, with the object of stiffening the support structure. Except for the area of the structure that contacts the faceplate, the ceramic is totally enclosed within the support structure. A devitrified glass frit may be used as a stiffening material, similarly enclosed within the structure.

OBJECTS OF THE INVENTION

It is a general object of the invention to provide an improved faceplate assembly for a color cathode ray tube having a tensed foil shadow mask and a substantially flat faceplate.

It is an object of the invention to provide a faceplate assembly having improved means for mounting a tensed foil shadow mask.

It is another object of the invention to provide an improved support structure and process for mounting a tensed foil shadow mask in association with a substantially flat faceplate.

It is a further object of this invention to provide a process for use in the manufacture of tension mask faceplate assemblies that eliminates rejects due to contamination and gassing.

It is a specific object of the invention to provide means and process for securing foil shadow mask support means to the faceplate that provide no cavities for entrapment of contaminants and the release of gases after the tube is sealed.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings (which are not to scale), in the several figures of which like reference numerals identify like elements, and in which:

DESCRIPTION OF THE PREFERRED EMBODIMENT

Figure 1:
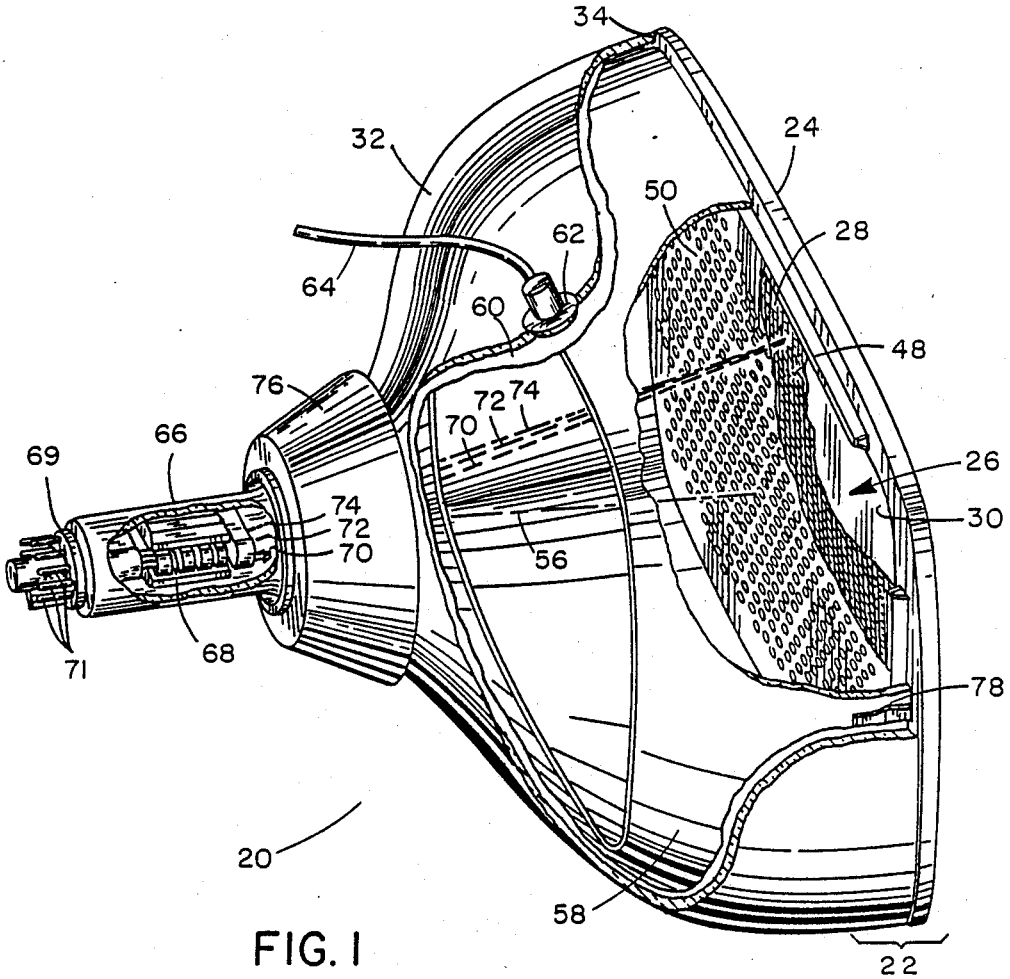
FIG. 1 is a side view in perspective of a color cathode ray tube having an improved shadow mask support structure according to the invention, with cut-away sections that indicate the location and relation of the structure to other major tube components.

A cathode ray tube having a faceplate assembly according to the invention with an improved structure for supporting a tensed foil shadow mask is depicted if FIG. 1. The tube and its component parts identified in FIGS. 1, 2 and 3, and described in the following paragraphs in this sequence: reference number, a reference name, and a brief description of structure, interconnections, relationship, functions, operation, and/or result, as appropriate.

20: color cathode ray tube
22: faceplate assembly
24: glass faceplate
26: inner surface of faceplate
28: centrally disposed phosphor screen
30: film of aluminum
32: funnel
34: peripheral sealing area of faceplate 24, adapted to mate with the peripheral sealing area of the mouth of funnel 32
48: shadow mask support structure according to the invention located on opposed sides of the screen 28 for receiving and securing a tensed foil shadow mask; the support structure is depicted by way of example as comprising a unitary structure
50: metal foil shadow mask; after being tensed, the mask is mounted on support structure 48 and secured thereto
52: shadow mask apertures, indicated as greatly enlarged in the inset for illustrative purposes
56: anterior-posterior axis of tube
58: magnetic shield, internal (a magnetic shield may also be installed external to the tube envelope)
60: internal conductive coating on funnel
62: anode button
64: high-voltage conductor
66: neck of tube
68: in-line electron gun providing three discrete in-line electron beams 70, 72 and 74 for exciting the respective red-light-emitting, green-light-emitting, and blue-light-emitting phosphor deposits on screen 28
69: base of tube
71: metal pins for conducting operating voltages, and video and sweep signals, through base 69 to the electron gun 68
76: yoke which provides for the traverse of beams 70, 72 and 74 across screen 28
78: contact spring which provides an electrical path between the funnel coating 60 and the mask support structure 48.

Figure 2:
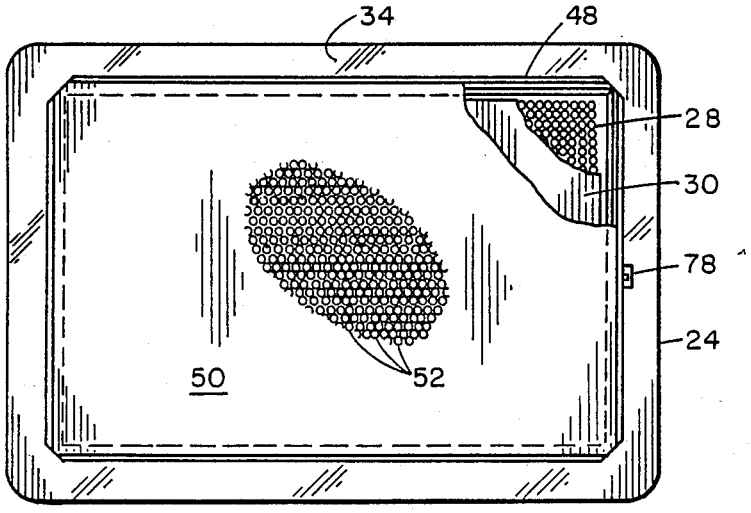
FIG. 2 is a plan view of the front assembly of the tube shown by FIG. 1, with parts cut away to show details of the relationship of the embodiment of the mask support structure shown by FIG. 1 with the faceplate and the shadow mask; an inset depicts the mask apertures greatly enlarged.
Figure 3:
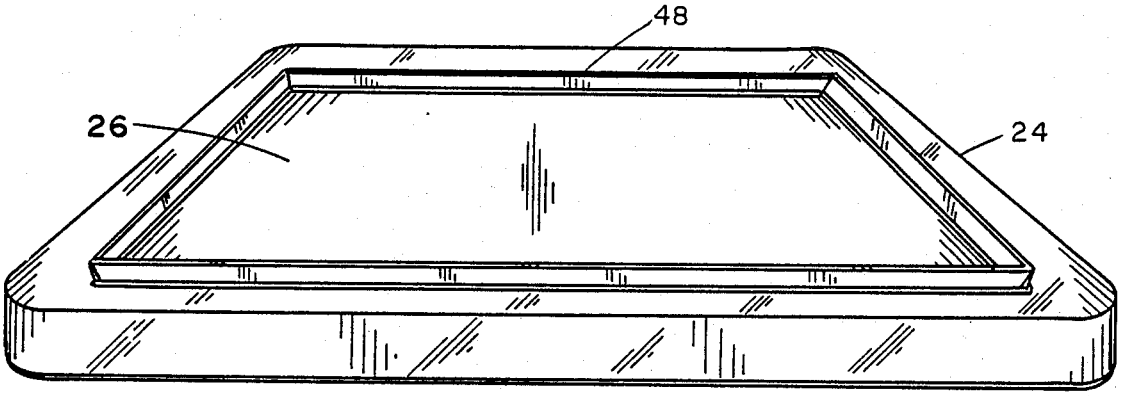
FIG. 3 is a view in perspective of the faceplate depicted in FIGS. 1 and 2, and showing in greater detail the location and orientation of a shadow mask support structure according to the invention as secured to the faceplate.

As indicated by FIGS. 1 and 2, a faceplate assembly 22 for a cathode ray tube 20 includes a glass faceplate 24 having on its inner surface 26 a centrally disposed phosphor screen 28. A foil shadow mask 50 is mounted in tension on shadow mask support structure 48 located on opposed sides of screen 28, and secured to the inner surface 26. A faceplate 24 without the shadow mask, but with a mask support structure 48 secured to the inner surface 26, is depicted in FIG. 3.

Figure 4:
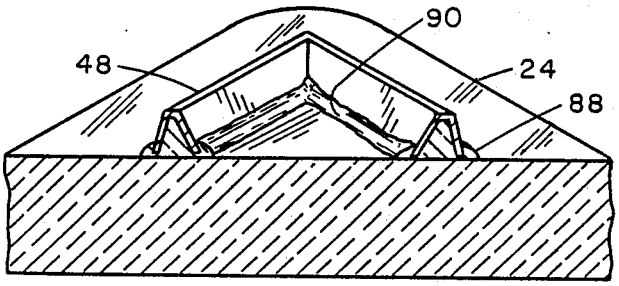
FIG. 4 is a cutaway perspective view of a corner section of the embodiment of the shadow mask support structure depicted in FIGS. 1–3.
Figure 5:
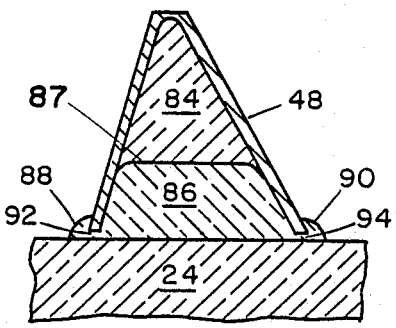
FIG. 5 is a sectional view in elevation indicating the distribution according to the invention of devitrified solder glass within a shadow mask support structure secured to a faceplate.

With reference also to FIGS. 4 and 5, shadow mask support structure 48 according to the invention is indicated as comprising a hollow shell, or tapered trough of metal, having in the preferred embodiment, a V-shape. The "bottom" of structure 48 (when the structure is inverted) is indicated as being partially filled according to the invention with a devitrified solder glass 84, noted as being a solder glass of relatively low viscosity when in the form of an undevitrified paste. The remainder of structure 48 is indicated as being completely filled with devitrified solder glass 86, noted as being a solder glass a relatively high viscosity when in the form of an undevitrified paste. A line of demarcation 87 is indicated between devitrified solder glass 84 and devitrified solder glass 86. The distribution of the two solder glasses within the support structure, and their devitrification, is a result of the inventive process to be described.

(It is to be noted that the inventive means and process is not limited to the embodiment of the support structure depicted, but may be utilized in conjunction with other configurations of hollow support structures such as round or rectangular.)

The devitrified solder glasses 84 and 86 comprise compositions selected to meet the particular requirements of the application according to the invention. The solder glass 84, indicated as occupying the bottom of structure 48, preferably comprises a solder glass of relatively low viscosity when in the form of an undevitrified paste, such as the solder glass manufactured by Corning Glass Works of Corning, N.Y., under the designation 7590. Alternately, a relatively low-viscosity solder glass designated as CV-685, and manufactured by Owens-Illinois Television Products Division of Toledo, Ohio, may be used. Devitrified solder glass 86, indicated as completely filling the remainder of structure 48, and being a solder glass of relatively high viscosity when in the form of an undevitrified paste, may comprise a solder glass provided by Corning under the designation 7590 PM. Alternately, solder glass CV-695 provided by Owens-Illinois, can be used. Solder glasses of equivalent properties and quality manufactured by other suppliers may as well be used.

The viscosity of solder glass in paste form can be measured by viscosimeters such as those manufactured by the Brookfield Engineering Laboratories, Inc. of Stoughton, Mass. under the designation Models LVT and HBT. For the low-viscosity pastes (7590 and CV-685), a Model LVT with a No. 1 spindle and Helipath Stand Model 20 is used. Viscosity readings of 160,000 to 240,000 centipoise are acceptable. For the high-viscosity pastes (7590 PM and CV-695), a Model HBT with a No. 29 spindle is used; readings of 350 to 550 poise are acceptable.

A further test of the rhealogy of the flow of the solder glass paste is the "bead width" test. The test consists of dispensing the subject paste through an orifice having a diameter of 0.125 inch, and depositing $85\pm2$ grams onto a plate. The width of the resulting bead is measured with a vernier caliper to a precision of 0.001 inch. The preferred range of bead widths of the low-viscosity solder glass pastes is from 0.260 to 0.300 inch. The preferred range of bead widths of the high-viscosity pastes is 0.180 to 0.220, with the best results obtained with pastes having a 0.190 to 0.205 inch bead width.

With reference to FIGS. 4 and 5, an overflow of solder glass from structure 48 is indicated, which provides fillets 88 and 90 of devitrified solder glass extending from structure 48 to seal structure 48 to the faceplate 24. Fillets 88 and 90 comprise seal geometries effective to provide the proper seal.

Gaps 92 and 94 will be noted between the "feet" of structure 48 and the faceplate 24. The width of the gaps may be in the range of 0.002 to 0.008 inch, and preferably about 0.005 inch. It is believed that, without the gaps, spalling of the glass of the faceplate may otherwise occur at points of contact with the metal of the support structure. In effect, the intervening solder glass seems to act as a "buffer" to compensate for the differing coefficient of thermal contraction ("CTC") of the metal of the support structure and the glass of the faceplate. The width of the gaps is a function of the quantities of the two solder glass pastes deposited in the support structure, and the shrinkage of the pastes as a result of heating to achieve shrinkage and devitrification.

The metal of the support structure may comprise Alloy No. 27 manufactured by Carpenter Technology of Reading, Pa.; this material has a CTC of approximately 105 to $109\times10^{-7}$ in/in/degree C. over the range of the temperatures required for devitrification--from ambient temperature to 435 degrees C. The glass of the faceplate in turn has a CTC of approximately $103\times10^{-7}$/degree C. over the designated range. Despite the relative nearness of the coefficients of thermal contraction of the glass and the metal, a gap with a buffer of solder glass between the metal of the mask support and the faceplate is considered necessary.

Figure 6A:
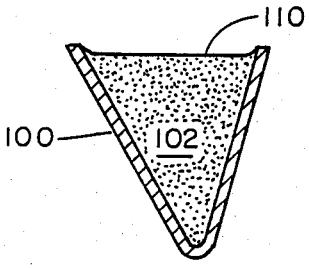
FIG. 6A is a sectional view in elevation depicting the filling of a mask support structure with devitrifying solder glass paste.

The final configuration of the support structure as secured to the faceplate, which is as depicted by FIGS. 3, 4 and 5, is a result of the process according to the invention. Regarding the inventive process, and with reference to FIGS. 6A, 6B, 7 and 8, a hollow shadow mask support structure 100 is provided for receiving and securing a foil shadow mask. The structure 100, depicted in cross-section in FIG. 6A, is indicated as having been formed (in this embodiment) into a tapered trough having a V-shape. The structure 100 according to the inventive process is indicated as being filled with a devitrifying solder glass paste 102 of relatively low viscosity. (Solder glasses in paste form are indicated symbolically by the dot pattern.)

Figure 7:
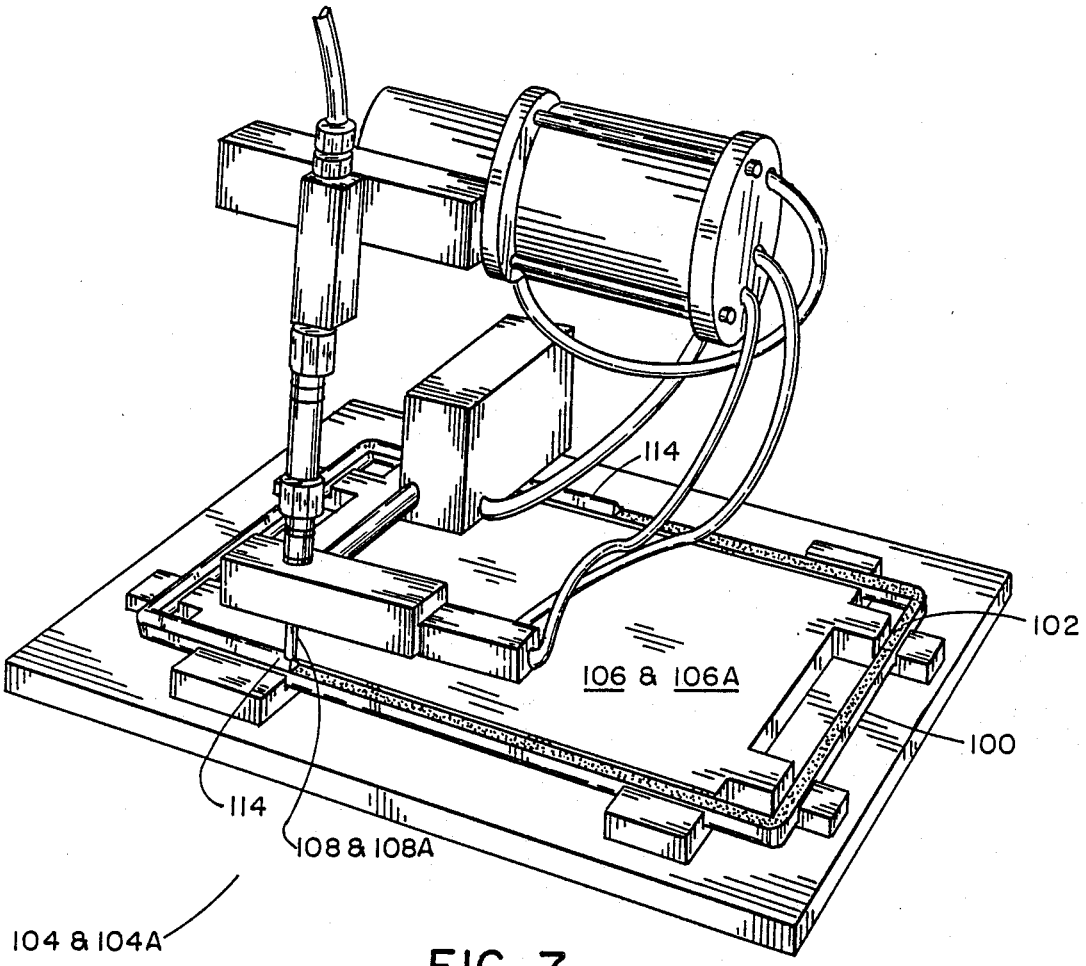
FIG. 7 is a simplified diagrammatic view of a machine for dispensing solder glass paste according to the inventive process.

The support structure 100 is depicted in FIG. 7 as installed in the receiving fixture 106 of a solder-glass-paste dispensing machine 104, indicated diagrammatically. The dispensing head 108 of machine 104 extrudes solder glass in paste form by means of a positive displacement cylinder, and with an accuracy of $\pm0.1$ gram. The dispensing head 108 remains stationary as the support structure 100, held in receiving fixture 106, is traversed to receive the dispensed solder glass paste.

It is to be noted that two such dispensing machines are used in the process according to the invention; they are identical except that each in sequence dispenses a solder glass paste of different viscosity; hence, the paste-dispensing heads may have a different orifice diameter. In this description, attribution to the second dispensing machine is indicated by the suffix "A" of the reference numbers that apply to the machine(s).

When installed in first dispensing machine 104, the support structure is filled with devitrifying solder glass paste 102 of relatively low viscosity (indicated by FIG. 6A) by a solder-glass paste-dispensing head 108, which preferably has an orifice size of 0.125 inch. The approximate fill level is indicated by the line 110 in FIG. 6A, which becomes a line of demarcation between two pastes of different viscosity. It is noted that the location of line 110 will change as the pastes shrink into the support structure, as indicated by the result of shrinkage which produced demarcation line 87 of FIG. 5.

Support structure 100 is removed from receiving fixture 106 and sent to an oven for drying. The preferred drying temperature is about 80 to 85 degrees C., and the duration of drying is in the range of 15 to 20 minutes. Drying serves to harden the solder glass paste and remove the more volatile portion of the vehicle.

Support structure 100 is then installed in a receiving fixture 106A in the second solder-glass paste-dispensing machine 104A, noted as being identical to the first solder glass-glass paste-dispensing machine 104. The orifice size of the paste-dispensing head 108A of the second machine 104A is made 0.187 inch in diameter because the thixotropic properties of the higher viscosity solder glass paste under shear make a larger orifice necessary.

Figure 6B:
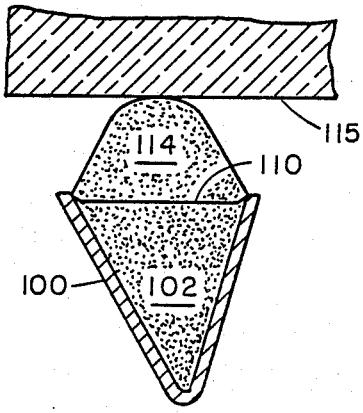
FIG. 6B is a view similar to FIG. 6A but depicting the over-filling, according to the invention, of a mask support structure with a second devitrifying solder glass paste having a different property.

In the second solder-glass dispensing machine 104A, the support structure 100 is over-filled according to the invention with a devitrifying solder glass paste of relatively high viscosity. This over-filling is indicated by FIG. 6B, in which solder glass paste 114 of higher viscosity is depicted as extending from the support structure 100 in an "ice-cream cone" configuration. By way of example, the solder glass paste 114 may extend above the level of support structure 100 by about 0.150 inch. The over-filling of the support structure 100 is also indicated by FIG. 7, in which solder glass paste deposit 114, depicted as having been partially applied by the second solderglass paste-dispensing machine 104A, is depicted as overlying the deposit of solder glass paste 102.

After receiving deposits of solder glass pastes 102 and 114, the support structure 100 is removed from the receiving fixture 106A and re-directed to the drying oven described, again for a period of 15 to 20 minutes at a temperature in the range of 80 to 85 degrees C.

Figure 8:
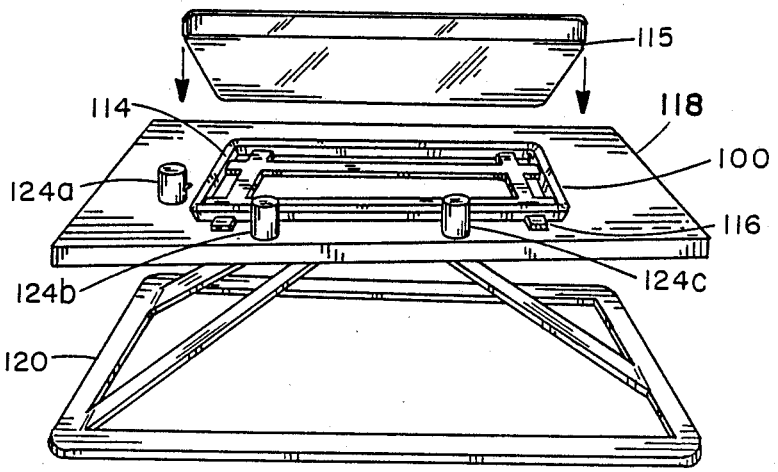
FIG. 8 is a view in perspective of a fixture for holding a faceplate and mask support structure in proper juxtaposition when passing through a sealing lehr.

With reference now to FIG. 8, a flat glass faceplate 115 is indicated by the associated arrows as about to be fixtured to rest upon devitrifying solder glass paste 114 of relatively high viscosity; that is, the solder glass paste that extends from the support structure 100. The fixturing is accomplished by cradling the support structure 100 is a holder 116 mounted on table 118 of a carrier base 120 for conveyance through a sealing lehr. Faceplate 115 is indicated as being in position for lowering (indicated by the associated arrows) onto the support structure 100 and in contact with the hardened solder glass paste 114.

The contact of the faceplate 110 with the solder glass paste 114 is depicted in greater detail in FIG. 6B. It will be noted that the solder glass paste 114 is shown as being strong enough to support the faceplate 122 without slumping or breaking—the strength or the hardness of the solder glass paste 114 is actually such that the seven-pound weight of the faceplate 115 does not make even a slight impression on the dried paste.

Table 118 of FIG. 7 is shown as being tilted for the purpose of registering the faceplate 122 with the support structure 100. Three indexing posts **124*a*, 124*b* and 124*c* provide for contact with three areas on the sides of faceplate 122; these are well-known in the art as the "faceplate a-b-c points." The tilting of table 118 causes the faceplate 115, impelled by gravity, to rest against posts 124*a*, 124*b* and 124*c*, providing for exact registration of the faceplate 115 with the support structure 100, noted as being cradled in the holder 116**.

The faceplate and support structure are then conveyed on carrier base 120 through a sealing lehr (not shown), where the assembly is heated by convection to a maximum sealing temperature of 440 degrees C. for a period of 35 to 45 minutes. The recommended rate of travel through the sealing lehr is about seven inches per minute, and the duration of the heating process is about 4½ hours. The heating of the faceplate 122 and the support structure 100 to the temperature and duration of time cited is effective to shrink the two solder glasses 102 and 114 into the structure, and lower the faceplate 122 into contiguousness with the support structure 100. The over-filling of the support structure 100 according to the invention also provides for a flow of solder glass paste to form fillets 90 and 92 which extend from structure 100, and which have seal geometries effective to seal the structure 100 to the faceplate 122.

As the carrier base 120 proceeds through the sealing lehr, the faceplate 122 and the support structure 100 are heated to the previously noted temperature of 440 degrees C. to devitrify the solder glasses and permanently secure and seal structure 100 to faceplate 122.

Following the securing of the support structure to the faceplate, the panel with the permanently secured mask support structure is conveyed to a panel screening area for the photoscreening of the phosphor deposits on the screening area enclosed by the support structure. Following the photoscreening, a shadow mask under tension is welded to the support structure, after which a magnetic shield (an internal shield is indicated by reference No. 58 of FIG. 1) may also be welded to the support structure, and the resulting combination, now the "faceplate assembly," is returned to the same sealing lehr for sealing the funnel to the peripheral, funnel-receiving area of the faceplate (see reference No. 34 in FIGS. 1 and 2).

The two solder glasses 102 and 114, upon melting and devitrifying, shrink in volume by approximately 36 percent. The effect of such shrinkage is depicted in FIG. 5, wherein the devitrified solder glasses 84 and 86 are indicated as completely filling the hollow space of support structure 48. The over-filling also provides for the flow of solder glass paste to form fillets 88 and 90 which extend from support structure 48, as indicated.

The width of the gaps 92 and 94 resulting from a near-conjunction of the mask support structure 48 with the glass of the faceplate 24, is a function of the volume of the two solder glass pastes deposited within, and extending from, the top of the support structure (depicted in FIG. 6B). As has been noted, the desired width of the gaps is in the range of 0.002 inch to 0.008 inch, and preferably 0.005 inch. The depositing of too much solder glass will result in gaps that are too wide, and the depositing of too little solder glass will reduce the gaps to a point where the metal of the support structure can contact the glass, which may result in spalling of the glass at the points of contact. By way of example, and with respect to the cubic volume of the particular mask support structure depicted, approximately 90 grams of the 7590 (or CV-685), relatively low viscosity solder glass paste 102, provides an adequate filling. Approximately 58 grams of solder glass 7590 PM (or CV-695)—the relatively high viscosity solder glass paste 114—provides an adequate over-filling. The total volume of both solder glasses for this particular support structure configuration is 33.6 cc, by way of example.

The quantities of paste deposited are preferably controlled to within ±0.045 cc, or 0.13 percent.

The objective to completely fill the mask support structure with solder glass, and provide the proper sealing geometries of the fillets 90 and 92, is achieved by the means and process according to the invention. Unless a complete filling of the support structure is attained, pockets can form that may entrap the compounds used in photoscreening the faceplate, or a gas such as air may be entrapped. Even a tiny pocket can contain enough impurities to poison a tube, or render it gaseous. Such imperfections can be costly, especially since they do not show up until final testing, and after the tube has been completely assembled. Before the process according to the invention was put into practice, reject rates of finished tubes were as high as 15 percent; as a result of the inventive process, reject rates were lowered to within a tolerable 0.2 to 0.4 percent.

Another benefit of the inventive process is that it is no longer necessary to apply solder glass paste directly on the faceplate. It has proved to be difficult to deposit just the right amount of paste on the narrow track on the faceplate where the support structure is to be secured; as a result, an excess of solder glass paste would often intrude upon the screening area. By the means and process according to the invention, the mask support structure can be precisely located with respect to the faceplate, and the exact amount of solder glass paste required is deposited with precision.

A third benefit lies in the fact that there is a thorough "wetting" of both the glass of the faceplate and the metal of the support structure by the two solder glasses. Thorough wetting is essential to the positive, overall securement of the mask support structure to the faceplate, and the minimization of stress concentrations in the glass of the faceplate.

While a particular embodiment of the invention has been shown and described, it will be readily apparent to those skilled in the art that changes and modifications may be made in the inventive means and process without departing from the invention in its broader aspects, and therefore, the aim of the appended claims is to cover all such changes and modifications as fall within the true spirit and scope of the invention.

What is claimed is:

1. A faceplate assembly for a color cathode ray tube including a glass faceplate having on its inner surface a centrally disposed phosphor screen, and a metal foil shadow mask mounted in tension on a mask-supported structure located on opposed sides of the screen and secured to said inner surface, said support structure comprising a hollow shell filled with at least two devitrified solder glass compositions each having a different viscosity when in the form of an undevitrified paste.

2. The faceplate assembly according to claim 1 wherein said support structure is metal in the form of a tapered trough.

3. The faceplate assembly according to claim 2 wherein said tapered trough has a V-shape.

4. A faceplate assembly for a color cathode ray tube including a glass faceplate having on its inner surface a centrally disposed phosphor screen, and a metal foil shadow mask mounted in tension on a mask-support structure comprising a tapered trough of metal having a V-shape located on opposed sides of the screen and secured to said inner surface, with the bottom of said structure partially filled with a devitrified solder glass of relatively low viscosity when in the form of an undevitrified paste, and with the remainder of said structure completely filled with devitrified solder glass of relatively high viscosity when in the form of an undevitrified paste.

5. The faceplate assembly according to claim 4 wherein an overflow of said solder glass from said structure provides for fillets of devitrified solder glass extending from said structure for sealing said structure to said faceplate.

6. A faceplate assembly for a color cathode ray tube including a glass faceplate having on its inner surface a centrally disposed phosphor screen, and a metal foil shadow mask mounted in tension on a mask-support structure comprising a tapered trough of metal having a V-shape located on opposed sides of the screen and secured to said inner surface, with the bottom of said structure partially filled with a devitrified solder glass of relatively low viscosity when in the form of an undevitrified paste, and with the remainder of said structure having an over-fill of devitrified solder glass of relatively high viscosity when in the form of an undevitrified paste, said solder glass, when devitrified, provided for securing said structure to said faceplate, and said over-fill providing for fillets of devitrified solder glass extending from said structure for sealing said structure to said faceplate.

* * * * *